US011225818B2

(12) United States Patent
Akimoto et al.

(10) Patent No.: US 11,225,818 B2
(45) Date of Patent: Jan. 18, 2022

(54) DOOR LEADING EDGE SENSOR

(71) Applicant: Hitachi Metals, Ltd., Tokyo (JP)

(72) Inventors: Katsuya Akimoto, Tokyo (JP); Kenji Kawase, Tokyo (JP); Shuichi Suzuki, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 135 days.

(21) Appl. No.: 16/217,199

(22) Filed: Dec. 12, 2018

(65) Prior Publication Data

US 2019/0186190 A1 Jun. 20, 2019

(51) Int. Cl.

| | |
|---|---|
| ***E05F 15/48*** | (2015.01) |
| ***E05F 15/44*** | (2015.01) |
| ***H01H 3/14*** | (2006.01) |
| *H01H 3/16* | (2006.01) |

(52) U.S. Cl.

CPC ..... *E05F 15/48* (2015.01); *E05F 15/44* (2015.01); *H01H 3/142* (2013.01); *E05Y 2400/54* (2013.01); *E05Y 2800/272* (2013.01); *E05Y 2800/28* (2013.01); *E05Y 2800/344* (2013.01); *E05Y 2800/678* (2013.01); *E05Y 2900/51* (2013.01); *H01H 2003/165* (2013.01)

(58) Field of Classification Search

CPC ..... E05F 15/44; E05F 15/48

See application file for complete search history.

(56) References Cited

U.S. PATENT DOCUMENTS

| | | | | |
|---|---|---|---|---|
| 6,740,826 | B1 * | 5/2004 | Friedrich | H01H 3/142 200/61.43 |
| 9,234,979 | B2 * | 1/2016 | Bolbocianu | G01V 3/02 |
| 10,622,167 | B2 * | 4/2020 | Sugita | H01H 1/14 |
| 10,745,956 | B2 | 8/2020 | Okada | |
| JP | 2002-004714 | | 1/2002 | |
| JP | 3107973 | * | 4/2005 | |

(Continued)

FOREIGN PATENT DOCUMENTS

| | | | |
|---|---|---|---|
| DE | 29808292 | U1 | 7/1998 |
| EP | 2774795 | A | 9/2014 |

(Continued)

OTHER PUBLICATIONS

Extended European Search Report issued in corresponding EP Application No. 18205556.6 dated May 8, 2019.

(Continued)

*Primary Examiner* — Gregory J Strimbu

(74) *Attorney, Agent, or Firm* — Roberts Calderon Safran & Cole P.C.

(57) ABSTRACT

A door leading edge sensor has a door leading edge elastic member which is attached to a front end portion of a door in a door closing direction and includes a cavity extending in a direction intersecting with the closing direction; a linear pressure sensitive sensor is attached to the door leading edge elastic member and is disposed along the extending direction of the cavity. The pressure sensitive sensor has an insulator tube having such an elasticity as to be deformed in accordance with an elastic deformation of the door leading edge elastic member and has plural conductive members fixed to an inner surface of the insulator tube. The plural conductive members are in a non-contact state when the insulator tube is not deformed and are in contact with each other when the insulator tube is deformed.

17 Claims, 23 Drawing Sheets

(56) References Cited

U.S. PATENT DOCUMENTS

| | | | | |
|---|---|---|---|---|
| 2002/0104373 | A1 | 8/2002 | Ishihara et al. | |
| 2004/0107640 | A1 | 6/2004 | Ishihara et al. | |
| 2010/0006407 | A1* | 1/2010 | Masuko | H01H 3/142 200/61.44 |
| 2011/0047879 | A1* | 3/2011 | Shimizu | E05F 15/44 49/358 |
| 2013/0333488 | A1* | 12/2013 | Ishihara | E05F 15/44 73/862.621 |
| 2016/0145927 | A1* | 5/2016 | Hirakawa | B60R 16/0215 296/1.04 |
| 2016/0305177 | A1* | 10/2016 | Koeda | E05F 15/48 |
| 2017/0040126 | A1* | 2/2017 | Takaba | H01H 3/142 |
| 2017/0328112 | A1* | 11/2017 | Okada | H03K 17/975 |
| 2017/0342762 | A1* | 11/2017 | Iino | E05F 15/44 |

FOREIGN PATENT DOCUMENTS

| | | | |
|---|---|---|---|
| JP | 2006-100035 | A | 4/2006 |
| JP | 2006-283312 | A | 10/2006 |
| JP | 2013-147195 | A | 8/2013 |
| JP | 2017-203661 | A | 11/2017 |

OTHER PUBLICATIONS

Office Action issued in corresponding Chinese Patent Application No. 201811482298.9 dated Nov. 27, 2020.

Office Action issued in corresponding Chinese Patent Application No. 201811482298.9 dated May 20, 2021.

Office Action issued in corresponding Japanese Patent Application No. 2017-240047 dated Jun. 1, 2021.

* cited by examiner

DOOR LEADING EDGE SENSOR

CROSS-REFERENCE TO RELATED APPLICATIONS

The present application is based on Japanese patent application No. 2017-240047 filed on Dec. 14, 2017, the entire contents of which are incorporated herein by reference.

FIELD OF INVENTION

The invention relates to a door leading edge sensor that is attached to a door for opening/closing an opening portion provided in a vehicle such as a railway vehicle so as to detect a door pinch during the door closing operation.

BACKGROUND ART

When a person passes through a door opening portion provided in a vehicle etc., a door pinching may occur in which a part of the person's body and personal belongings are caught in the door during the door closing operation. A door pinch detection device for detecting such a door pinch has been proposed (e.g., see PTLs 1, 2)

The door pinch detecting device disclosed in PTL 1 is provided with a hollow portion having a circular cross section in the attachment portion of the door leading edge rubber attached to the leading edge of each door of the railway vehicle, and a cylindrical part in a cavity portion inside of the door leading edge rubber. The door pinch detection device is configured to detect a door pinching state by detecting the difference between the reference pressure data obtained from the hollow portion and the internal pressure data obtained from the cylindrical portion so as to judge the deformation state of the door leading edge rubber.

The door pinch detection device disclosed in PTL 2 is configured to detect the occurrence of door pinching by detecting a change in the amount of electric charge generated from a piezoelectric material disposed inside the door leading edge rubber when the door pinching occurs.

CITATION LIST

Patent Literatures

PTL 1: JP 2006/283312 A
PTL 2: JP 2013/147195 A

SUMMARY OF INVENTION

Technical Problem

The door pinch detection device disclosed in PTL 1 operates such that the presence or absence of a door pinching is determined based on a change in the internal pressure of the cylindrical portion. Thus, the door pinch detection device may have a problem detecting a small foreign matter unless the small foreign matter is caught deeply since it has difficulty causing a deformation of the cylindrical portion. For example, an object such as a bag having a large contact area with the door leading edge rubber is easily detected, but an object such as fingers having a small contact area with the door leading edge rubber is not easily detected unless it is caught deeply.

The door pinch detection device disclosed in PTL 2 cannot detect whether or not the door pinching state is continuing since the door pinch is detected by a change in the amount of electric charge generated from the piezoelectric material after the door pinch occurs. For example, it may continue to erroneously recognize the door pinching state even if the contact state with the foreign object is released after the door pinching is detected by the crash of the foreign object against the door.

It is an object of the invention to provide a door leading edge sensor that is enabled to detect a door pinching state without depending on a contact area between the door leading edge rubber and the foreign object and that is enabled to determine whether or not the door pinching state is continued.

According to an embodiment of the invention, a door leading edge sensor defined below can be provided.

[1] A door leading edge sensor, comprising:

a door leading edge elastic member which is attached to a front end portion of a door in a door closing direction and in which a cavity extending in a direction intersecting with the closing direction is formed therein; and a linear pressure sensitive sensor that is attached to the door leading edge elastic member and is disposed along the extending direction of the cavity, wherein the pressure sensitive sensor has an insulator tube having such an elasticity as to be deformed in accordance with an elastic deformation of the door leading edge elastic member and plural of conductive members fixed to an inner surface of the insulator tube, and wherein the plural of conductive members are in a non-contact state when the insulator tube is not deformed and are in contact with each other when the insulator tube is deformed.

[2] The door leading edge sensor according to [1], wherein the pressure sensitive member is attached to a side portion of the door leading edge elastic member except for both ends in an opening and closing direction of the door.

[3] The door leading edge sensor according to [2], wherein a pair of the pressure sensitive members sandwich a center plane in a thickness direction of the door parallel to the opening and closing direction of the door, and are attached to the side portions on one side and an other side of the center plane.

[4] The door leading edge sensor according to [3], wherein the pressure sensitive member is attached so that a center of the insulator tube is located closer to the closing direction side of the door than a reference line that is perpendicular to the center plane of the door and passes through a center of the cavity.

[5] The door leading edge sensor according to any one of [1] to [4], wherein a recess extending along the extending direction of the cavity is formed on an inner wall surface of the door leading edge elastic member, and at least a part of the pressure sensitive member is disposed in the recess.

[6] The door leading edge sensor according to any one of [1] to [5], wherein a part of the pressure sensitive member is exposed to the cavity.

[7] The door leading edge sensor according to any one of [1] to [6], wherein a rigid member harder than the door leading edge elastic member is attached to the door leading edge elastic member and the pressure sensitive member is attached closer to the closing direction side of the door than the hard member.

[8] The door leading edge sensor according to [7], wherein at least a part of the rigid member is accommodated in a concave portion formed in an inner wall surface of the door leading edge elastic member.

[9] The door leading edge sensor according to [7] or [8], wherein t the rigid member is disposed at a position exposed to the cavity.

[10] The door leading edge sensor according to any one of [7] to [9], wherein the rigid member is formed of a rod-shaped metal.

[11] The door leading edge sensor according to [4], wherein the pressure sensing member is disposed at a position where an angle between a straight line and the reference line is 10° to 30°, and wherein the straight line connects the center of the insulator tube and the center of the cavity.

[12] The door leading edge sensor according to [4], wherein the pressure sensing member is disposed at a position where an angle between a straight line and the reference line is 20° to 30°, and wherein the straight line connects the center of the insulator tube and the center of the cavity.

[13] The door leading edge sensor according to [1], wherein the door leading edge elastic member has a protrusion protruding toward the center of the cavity, and the pressure sensitive member is attached to an end of the protrusion in a projecting direction.

[14] The door leading edge sensor according to [1], wherein the door leading edge elastic member has plural of protrusions protruding toward the center of the cavity, and the pressure sensitive member is attached to a position sandwiched between the plural of protrusions.

Effect of the Invention

According to an embodiment of the invention, a door leading edge sensor can be provided that is enabled to detect a door pinching state without depending on a contact area between the door leading edge rubber and the foreign object and that is enabled to determine whether or not the door pinching state is continued.

BRIEF DESCRIPTION OF DRAWINGS

Next, the present invention will be explained in more detail in conjunction with appended drawings, wherein.

EMBODIMENT

Figure 1:
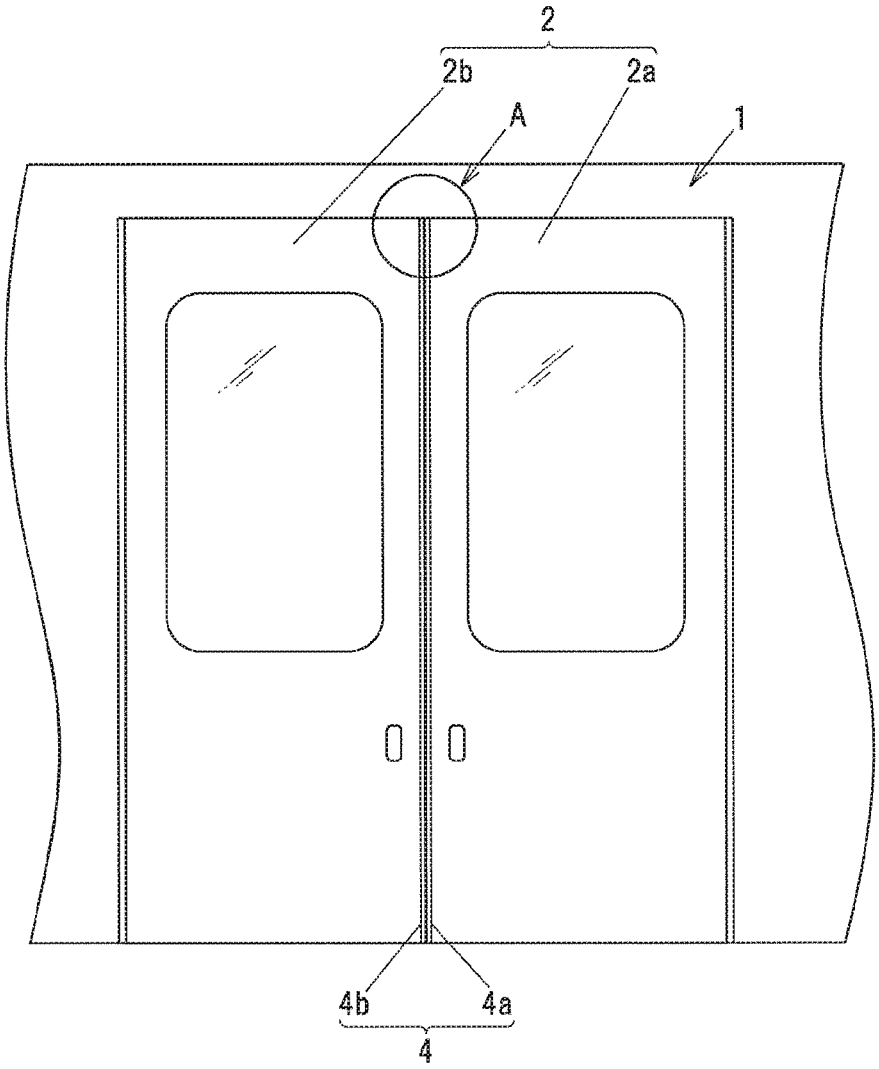
FIG. 1 is a front view of a train door to which a door leading edge sensor is applied in the first embodiment of the invention.

An embodiment of the invention will be described in conjunction the drawings. It should be noted that the same reference numerals are assigned to the constituent elements having substantially the same function, and the redundant explanations are omitted.

First Embodiment

FIG. 1 is a front view of a train (a rail road car) door to which a door leading edge sensor is applied in the first embodiment of the invention.

As shown in FIG. 1, a pair of doors 2 (2 *a*, 2 *b*) which slide in a left-right direction in FIG. 1 to open and close a door opening portion are provided at the door opening portion which is an entrance on the side surface of the train vehicle 1. A pair of door leading edge rubbers 4 (4*a*, 4*b*) as the door leading edge elastic member are attached to a front end portion of the door, respectively, in a closing direction, which is a moving direction when sliding type doors 2*a*, 2*b* are closed. The door leading edge rubber 4 is made of synthetic rubber and is attached along the vertical direction of the entrance (vertical direction in the FIG. 1). The pair of door leading edge rubbers 4 (4*a*, 4*b*) arranged to face the pair of doors 2 (2*a*, 2*b*) are in contact with each other as shown in FIG. 1 when the door 2 (2*a*, 2*b*) is closed.

Figure 2:
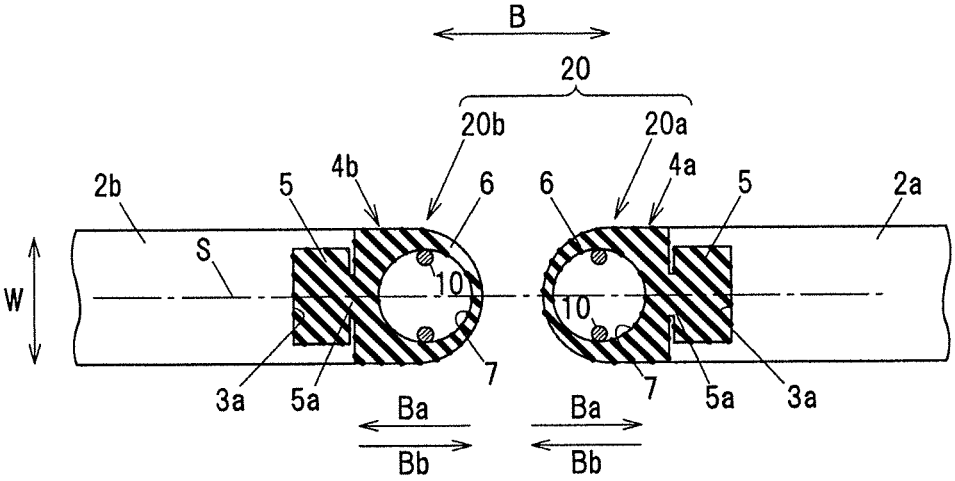
FIG. 2 is a transverse sectional view showing a schematic configuration enlarging the portion A of FIG. 1 as viewed from above.

FIG. 2 is a transverse sectional view showing a schematic configuration enlarging the portion A of FIG. 1 as viewed from above. In FIG. 2, B means an opening and closing direction of the door 2, Ba means an opening direction of the door 2, and Bb means a closing direction of the door 2. In the case where the door 2 (2*a*, 2*b*) is completely closed, the door leading edge rubber 4 *a* and the door leading edge rubber 4 *b* are actually in contact with each other. However, in FIG. 2, a slight gap is shown between the door leading edge rubber 4*a* provided at the front end portion of the door 2*a* and the door leading edge rubber 4*b* provided at the front end portion of the door 2*b*, for the sake of clarity.

Since the door leading edge rubber 4*a*, 4*b* attached to the right and left doors 2*a*, 2*b* have the same configuration, the door leading edge rubber 4*a* attached to the right door 2*a* will be described below. The door leading edge rubber 4*a* includes a mounting part 5 for mounting to the door 2*a*, an abutment part 6 disposed closer to the closing direction Bb side of the door than the mounting part 5, and a connecting part 5 *a* connecting the mounting part 5 and the abutment part 6. The mounting part 5 is fitted into a mounting groove 3*a* provided at the distal end of the door 2*a* in the closing direction Bb. The abutment part 6 of the door 2*a* abuts on the abutment part 6 of the other door 2*b* when the door is closed. A cavity 7 extending in a direction intersecting the closing direction Bb is formed inside the abutment part 6. In the present embodiment, the extending direction of the cavity 7 is a vertical direction perpendicular to the opening and closing direction B of the door 2.

The cavity 7 is formed at a position including a center plane S in the opening and closing direction B of the door 2*a* and in a thickness direction of the door 2*a* bisecting a thickness direction W of the door 2*a* when the door leading edge rubber 4*a* is attached to the door 2*a*. In the example shown in FIG. 2, a cross section of the cavity 7 has a circular shape symmetrical with respect to the center plane S. However, the cross sectional shape of the cavity 7 does not need to be circular, and may not be symmetrical with respect to the center plane S. A shape of the cross section of the cavity 7 may be, e.g., elliptical, semicircular or crescent shaped other than circular, other square, rectangular, trapezoidal.

A code switch 10 as a linear pressure sensitive member arranged along an extension direction of the cavity 7 is attached to the door leading edge rubber 4*a*. Although the details of the configuration of the code switch 10 will be described later, the cord switch 10 has an insulator tube having elasticity which is deformed in accordance with elastic deformation of the door leading edge rubber 4 *a* and plural of conductive members fixed to an inner face of the insulator tube. The plural of conductive members is in a non-contact state in a non-deformed state of the insulator tube, and are configured to contact each other when the insulator tube is deformed.

In FIG. 2, the cord switch 10 sandwiches the center plane S in the thickness direction of the door 2*a*, and is disposed at two positions, one side and the other side (outside and inside of the vehicle 1) of the center plane S. The code switch 10 may be arranged on only one side. A more preferable position of the code switch 10 will be described in detail later on the basis of a simulation result to be described later.

In this way, by arranging the code switch 10 on the door leading edge rubber 4 (4*a*, 4*b*), the door leading edge sensor 20 (20*a*, 20*b*) including the door leading edge rubber 4 (4*a*, 4*b*) and the code switch 10 is formed.

Figure 3:
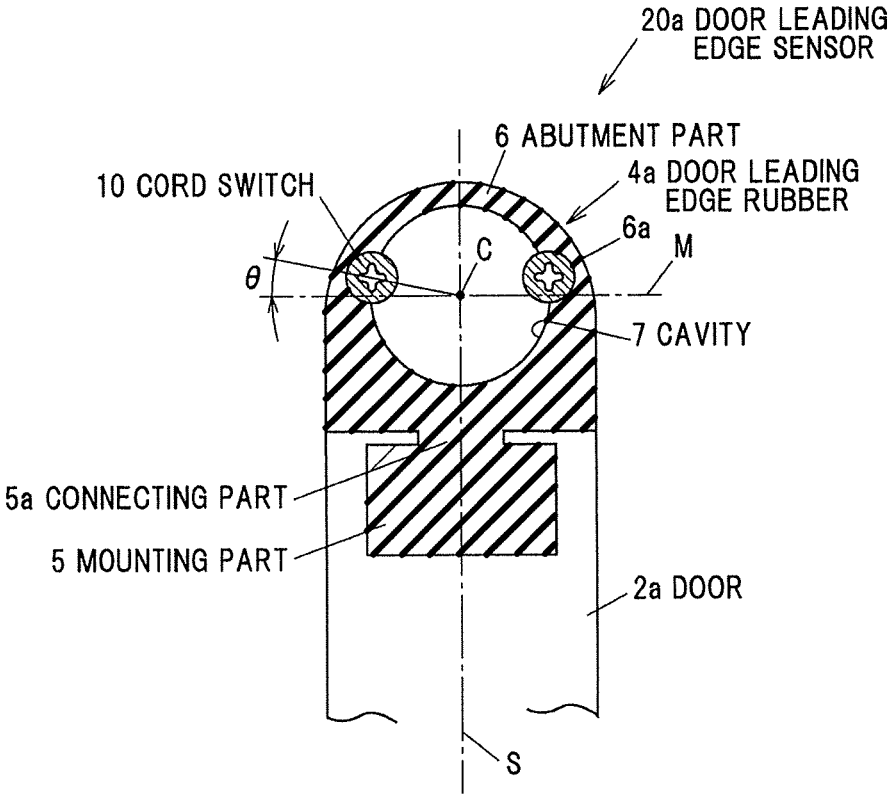
FIG. 3 is a cross sectional view showing a door leading edge sensor in the first embodiment of the invention.

FIG. 3 is a cross sectional view showing a door leading edge sensor 20 in the first embodiment of the invention. In FIG. 3, the code switch 10 is schematically shown. The door leading edge sensor 20 will be described in more detail with reference to FIG. 3. FIG. 3 shows a door leading edge sensor 20*a* provided at the front end portion of one door 2*a*. The door leading edge sensor 20*b* provided at the front end portion of the other door 2*b* is the same as one door leading edge sensor 20*a*, so one door leading edge sensor 20*a* will be described below.

The door leading edge rubber 4*a* includes the mounting part 5, the abutment part 6, and the connecting part 5*a* connecting the mounting part 5 and the abutment part 6. The cavity 7 is provided on the center plane S in the thickness direction W (see FIG. 2) of the door of the abutment part 6. On the inner wall surface of the door leading edge rubber 4*a*, an arcuate recess 6*a* extending along an extending direction of the cavity 7 is formed. The recess 6*a* has a radius corresponding to the diameter (e.g., 4 mm) of the code switch 10. The cord switch 10 is provided so that a part thereof is arranged in the recess 6*a* along the recess 6*a* and the other part is exposed in the cavity 7. Here, "to be exposed" means that a part of the code switch 10 protrudes toward a center C of the cavity 7 from an inner surface of the abutment part 6 of the portion where the recess 6*a* is not formed. The door leading edge rubber 4*a* can be formed by a method, e.g., injection molding or extrusion molding. The cord switch 10 is joined to the recess 6*a* by, e.g., an adhesive or welding.

Herein, a mode of "a linear pressure sensitive sensor that is attached to the door leading edge elastic member and is disposed along an extending direction of the cavity" is not limited to a mode in which the pressure sensitive member is fixed by joining the cord switch 10 to the door leading edge rubber 4*a*, as in the first embodiment and the second embodiment to be described later. That mode includes a method of holding the cord switch 10 by plural of protrusions protruding toward the center of the cavity 7 as in a third embodiment to be described later. Also, that mode includes a mode in which the cord switch 10 is disposed on the surface of the protrusion so that the cord switch 10 is not fixed to the door leading edge rubber 4*a* by, e.g., adhesives or welding as in the fourth embodiment to be described later.

As shown in FIG. 3, in the present embodiment, the cord switch 10 is attached to a side portion of the door leading edge rubber 4*a* except for both ends in the opening and closing direction B of the door 4*a*. More specifically, a pair of code switches 10 sandwich the center plane S of the door 4*a*, and the pair of cord switches 10 are attached to respective sides of one side (the outside of the vehicle 1) of the center plane S and the other side (the cabin side of the vehicle 1). Here, the side portion is a portion excluding both end portions in the opening and closing direction B of the door leading edge rubber 4*a* crossing the center surface S, and since the cord switch 10 is attached to that side portion, the center plane S does not cross the code switch 10.

Further, the code switch 10 is attached so that the center of the code switch 10 (the center of an insulator tube 11 described later) is located closer to the closing direction Bb side of the door 4*a* than a reference line M that is perpendicular to the center plane S of the door 4*a* and passes through the center C of the cavity 7. A preferable value of an angle (a mounting angle) θ formed by a straight line and the reference line M will be described based on a simulation result later, and wherein the straight line connecting the center of the code switch 10 and the center C of the cavity 7.

Cord Switch

Figure 4:
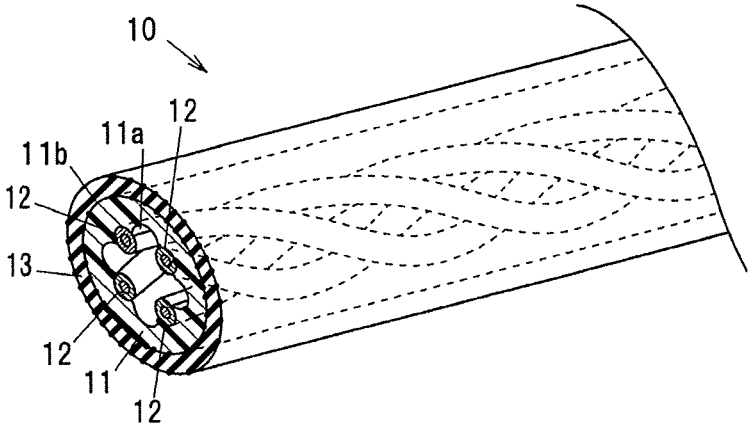
FIG. 4 is a perspective view of a main part of a cord switch according to the present embodiment.

Next, the code switch 10 will be described with reference to FIG. 4. FIG. 4 is a perspective view of a main part of the cord switch 10 of the present embodiment.

As shown in FIG. 4, the cord switch 10 has an insulator tube 11 having elasticity and electrical insulation properties, a tubular code cover 13 covering the insulator tube 11, and four electrode wires 12 as plural of conductive members arranged so as to face each other with an interval on an inner surface of the insulating tube 11. In this embodiment, the cord cover 13 is used for protecting and reinforcing the insulator tube 11, but the cord cover 13 may be omitted.

In the present embodiment, the outer surface 11*b* of the insulator tube 11 is cylindrical, and a hollow portion 11*a* having a cruciform cross sectional shape orthogonal to the longitudinal direction is formed at the center portion of the insulator tube 11. In an inner surface of the hollow portion 11*a*, a part of the four electrode wires 12 is exposed in the hollow portion 11*a* and is held spirally in an electrically non-contact state. The insulator tube 11 deforms when an external force is applied and has an elasticity (restorability) for restoring immediately as soon as an external force disappears.

As a material of the insulator tube 11 having such characteristics, a rubber material such as, e.g., silicone rubber, ethylene propylene rubber, or an elastic plastic such as, e.g., polyethylene, ethylene vinyl acetate copolymer, ethylene ethyl acrylate copolymer, ethylene methyl methacrylate copolymer can be used.

The four electrode wires 12 have the same configuration. The four electrode fights 12 are arranged at equal intervals on the inner surface of the hollow portion 11*a* of the insulator tube 11 and are spirally arranged in the insulator tube 11. In the present embodiment, the four electrode wires 12 are held on the inner surface of the hollow portion 11*a* while being separated from each other (in a non-contact state) only by the elastic force of the insulator tube 11.

Although not shown, each of the electrode wires 12 is made up of plural of metal wires and a conductive coating layer having conductivity for collectively covering each of the plural of metal wires. Each of the electrode wires 12 has a circular cross section. This metal wire uses a metal stranded wire in which plural of metal strands is twisted together so as to obtain excellent bendability and elasticity. The conductive coating layer is, e.g., made of an admixture in which a conductive filler such as carbon black is compounded in rubber or elastic plastic. The cross sectional area of the conductive coating layer is preferably twice or more the cross sectional area of the metal wire. Thereby, enough elasticity is imparted to the electrode wire 12, and the electrode wire 12 is appropriately held by the insulator tube 11.

The code cover 13 is formed in a tubular shape, and accommodates the insulator tube 11 holding the electrode wire 12 in the hollow portion 11*a* to protect them. The cord cover 13 is made of, e.g., urethane rubber, EP rubber, silicone rubber, styrene butadiene rubber, chloroprene rubber, olefin or styrene type thermoplastic elastomer, urethane resin.

Figure 5:
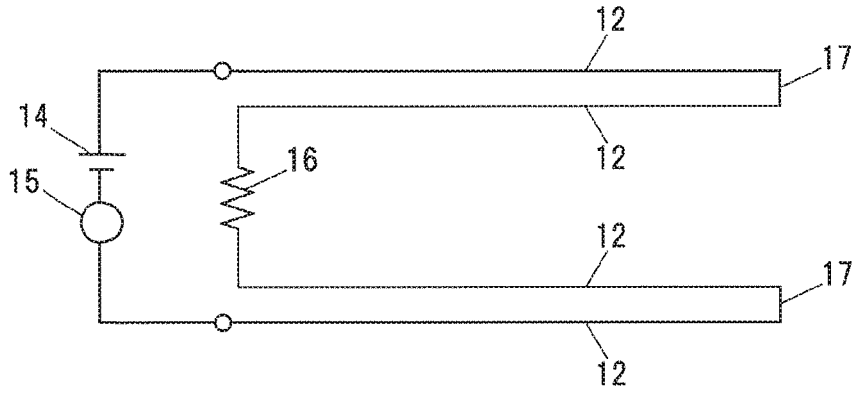
FIG. 5 is a schematic circuit diagram for explaining the principle of the code switch.

FIG. 5 is a schematic circuit diagram for explaining the principle of the code switch 10. A power supply 14 and ammeter 15 are connected between one end of each of the two electrode wires 12 out of the four electrode wires 12. A resistor 16 is connected between one end of each of the other two electrode wires 12. And the electrode wires 12 are directly connected to each other at the other end 17. Thus, a series circuit including the power supply 14, the ammeter 15, the electrode wire 12, and the resistor 16 is formed.

Generally, weak surveillance current is applied to this circuit, and when any one of the four electrode wires 12 comes into contact due to a load from the outside, a short-circuit current flows. This allows the circuit to detect anomalies based on an increase in short-circuit current.

Door Pinch Detection System

Figure 6:
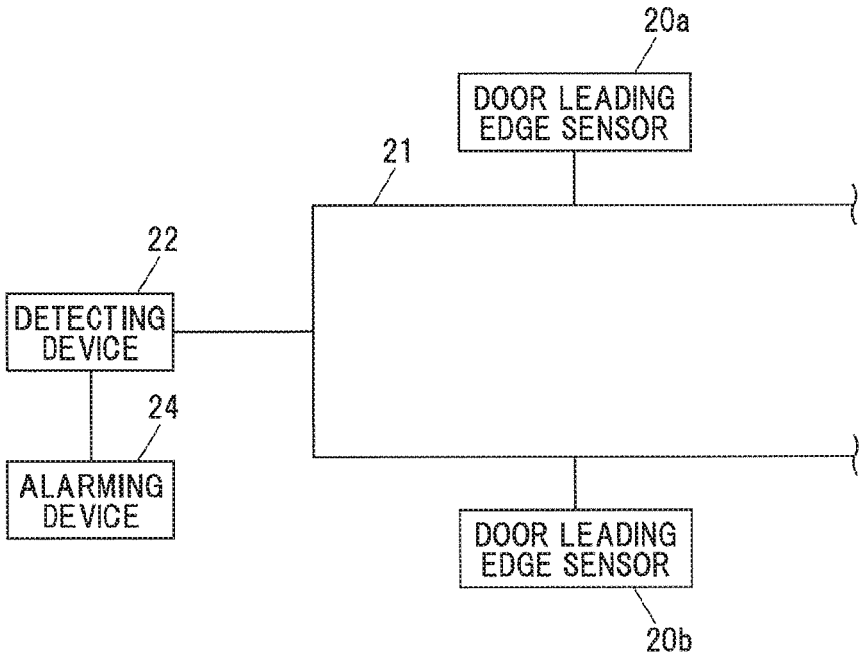
FIG. 6 is a circuit diagram showing a schematic configuration of a pinch detection system using the door leading edge sensor of the present embodiment.

FIG. 6 is a circuit diagram showing a schematic configuration of a pinch detection system using the door leading edge sensor 20 of the present embodiment.

As shown in FIG. 6, in a door pinch detection system, each door leading edge sensor 20 disposed in each door of the vehicle is connected to a detecting device 22 through a line 21. Weak surveillance current flows through the door leading edge sensors 20*a* and 20*b* through the line 21, and a door pinching state occurs in any of the door leading edge sensors 20*a* and 20*b*. When a large current flows through the code switch 10, the detecting device 22 detects this as a detection signal.

The detecting device 22 is disposed, e.g., in the crew member's room. The detecting device 22 is preferably controlled so as to send a current to the door leading edge sensors 20*a* and 20*b* in a time division manner and to receive a detection signal in order to detect at which door the door pinching state has occurred. Further, an alarming device 24 is connected to the detecting device 22, and when the detecting device 22 detects occurrence of a door pinching state, the door where the door pinching state occurs may be displayed and the warning sound or light may be used to notify the door.

Effects of the First Embodiment

According to the door leading edge sensor 20 of the first embodiment, the following actions and effects are obtained.

(1) The cord switch 10 is arranged along the extending direction of the cavity 7, and the insulator tube 11 of the cord switch 10 is deformed in accordance with the elastic deformation of the door leading edge rubber 4*a*. As a result, since the plural of electrode wires 12 are brought into contact with each other, it is possible to detect the door pinching state without depending on the contact area between the door leading edge rubber 4*a* and the foreign matter.

(2) The code switch 10 sandwiches the center plane S of the door 2*a* and is provided at two positions on the inner wall surface on both sides in the thickness direction W of the door 2*a* in the door leading edge rubber 4*a*. As a result, it is possible to stably detect the door pinching state.

(3) In the cord switch 10, the plural of electrode wires 12 are in contact with each other as long as the elastic deformation of the door leading edge rubber 4 *a* is continued due to pinching. As a result, it is possible to detect the door pinching state with a simple configuration only by detecting the ON/OFF thereof, and it is also possible to determine whether or not the door pinching state is continuing.

(4) Since a part of the code switch 10 is provided so as to be exposed in the cavity 7, the cord switch 10 is sandwiched between the corner portions (an edge portion of the recess 6*a*) of the door leading edge rubber 4*a* by the deformation of the abutment part 6 at the time of door pinching, and receives the pressure. As a result, it is possible to detect the door pinching state early.

(5) By adjusting the mounting angle θ of the cord switch 10, it is possible to adjust the load and the pushing amount for detecting the door pinching state.

Second Embodiment

Figure 7:
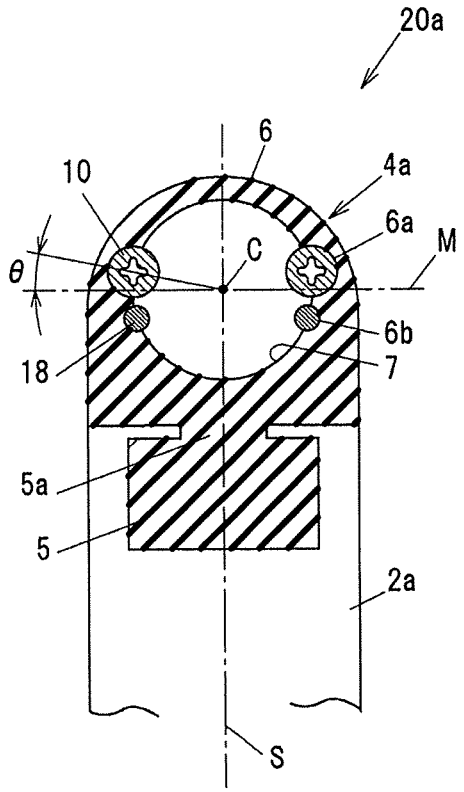
FIG. 7 is a cross sectional view showing a door leading edge sensor in the second embodiment of the invention. Description of Embodiments

FIG. 7 is a cross sectional view showing a door leading edge sensor 20 according to a second embodiment of the present invention. In the present embodiment, a rigid member 18 that is harder than the door leading rubber 4*a* is added to the first embodiment. Hereinafter, differences from the first embodiment will be mainly described.

In FIG. 7, the arrangement position of the cord switch 10 on the inner wall surface of the door leading edge rubber 4*a* is the same as that in the first embodiment described above. In the second embodiment, a rigid member 18 harder than the door leading edge rubber 4*a* is attached to the door leading edge rubber 4*a*, and the cord switch 10 is attached to closer to the closing direction Bb side of the door 2*a* than the rigid member 18. A part of the rigid member 18 is accommodated at least in a concave portion 6*b* formed parallel to the recess 6*a* where the cord switch 10 is disposed. The other part of the code switch 10 is disposed at a position exposed to the cavity 7.

The rigid member 18 is not particularly limited, but a material having a Young's modulus of ten times higher than that of the door leading edge rubber 4, e.g., a bar-shaped metal material such as a wire is preferable. If the hard member 18 is harder than the door leading edge rubber 4*a*, resin or rubber may be used. The concave portion 6*b* has a radius corresponding to the diameter (e.g., 2 mm) of the rigid member 18. The rigid member 18 is provided along the concave 6*b*. The rigid member 18 is joined to the concave portion 6*b* by, e.g., an adhesive, welding.

Effect of the Second Embodiment

According to the door leading edge sensor 20 of the second embodiment, the following actions and effects are obtained.

(1) Since the rigid member 18 which is harder than the door leading edge rubber 4*a* is attached closer to the opening direction Ba side of the door 2*a* than the cord switch 10, the rigidity of the door 2*a* in the opening direction Ba side is larger than that of the cord switch 10 and it is possible to detect the door pinching state with a small deformation amount and a small load as compared with the first embodiment.

(2) As in the first embodiment, by adjusting the mounting angle θ of the cord switch 10, it is possible to adjust the load and the pushing amount for detecting the door pinching state.

Third Embodiment

FIG. 8 is a cross sectional view showing a door leading edge sensor 20 according to a third embodiment of the present invention. In the present embodiment, the arrangement position of the code switch 10 is changed with respect to the first embodiment. Hereinafter, differences from the first embodiment will be mainly described.

In the door leading edge sensor 20 according to the third embodiment, the door leading edge rubber 4 has plural of protrusions 41 protruding toward the center of the cavity 7, and the code switch 10 is mounted at a position where it is sandwiched by the plural of projections 41, 42. More specifically, the cord switch 10 is sandwiched between a pair of trapezoidal protrusions 41, 42, and is disposed at substantially the center of the cavity 7. The pair of projections 41, 42 is arranged in parallel along the opening and closing direction B of the door 2. The protrusion 41 is provided on the side of the code switch 10 in the closing direction Bb and the protrusion 42 is provided on the side of the code switch 10 in the opening direction Ba. The projections 41, 42 are provided over the entire longitudinal direction of the door leading edge rubber 4.

Effect of the Third Embodiment

According to the door leading edge sensor 20 of the third embodiment, it is possible to obtain the same actions and effects as those of the first embodiment. Further, when pinching occurs, the cord switch 10 is sandwiched between the protrusion 41 and the protrusion 42 arranged in the opening and closing direction B of the door 2, and the plural of electrode wires 12 come into contact with each other. As a result, compared with the first and second embodiments, it is possible to detect the door pinching state with a smaller amount of deformation and with a small load.

Fourth Embodiment

FIG. 9 is a cross sectional view showing a door leading edge sensor 20 according to a fourth embodiment of the present invention. This embodiment is a modification of the supporting method of the cord switch 10 with respect to the third embodiment. Hereinafter, differences from the third embodiment will be mainly described.

In the door leading edge sensor 20 according to the fourth embodiment, the door leading edge rubber 4 has a protrusion 42 protruding toward the center of the cavity 7 and the cord switch 10 is attached to the end portion of the projection 42 in the projecting direction. The protrusion 42 is provided on the opening direction side of the code switch 10 and protrudes toward the closing direction of the door 2. The door leading edge rubber 4 has a protrusion 41 having a protrusion amount smaller than that of the protrusion 42 on the closing direction side of the cord switch 10, and a gap is formed between the protrusion 41 and the code switch 10. That is, in the fourth embodiment, the cord switch 10 is not clamped by the pair of protrusions 41, 42, but protrusion 41 is smaller than the protrusion 42. With this configuration, the cord switch 10 is disposed at substantially the center of the cavity only by the projection 42.

In the door leading edge sensor 20 according to the fourth embodiment, when no pinch is occurring, the projection 41 does not abut the code switch 10. When the door pinch occurs, the protrusion 41 comes into contact with the code switch 10 and presses the cord switch 10 with the protrusion 42. As a result, the plural of electrode wires 12 of the cord switch 10 comes into contact with each other.

Effect of the Fourth Embodiment

According to the door leading edge sensor 20 of the fourth embodiment, the same operation and effect as those of the third embodiment can be obtained. Further, since a gap is formed between the protrusion 41 and the cord switch 10, the pain when, e.g., a finger is caught between the protrusion 41 and the code switch 10 is reduced as compared with the third embodiment.

Simulation Result on Mounting Position of Cord Switch

Hereinafter, results of various simulations on the position where the cord switch 10 is attached to the door leading edge rubber 4 will be described in detail.

In this simulation, when the cord switch 10 is attached to various positions of the door leading edge rubber 4 and a load is applied to the door leading edge rubber 4, the relationship between the load and the amount of deformation (pushing amount) of the door leading edge rubber 4*a* is examined in each case. More specifically, the relationship between the load and the amount of deformation (pushing amount) of the door leading edge rubber when the semicircular lower portion radius of a pressing member 40 is changed every 5 mm was investigated. As an analysis tool, ANSYS Mechanical (platform: ANSYS Workbench 14.5) of Cybernet Systems Inc. was used. The analysis model was ¼ model. The Young's modulus of the door leading edge rubber 4 was 3 MPa and the Poisson's ratio was 0.49. Assuming that the cord switch 10 is a general elastic body, the Young's modulus is 9 MPa and the Poisson's ratio is 0.49. This condition is the same in other simulations.

Figure 10:
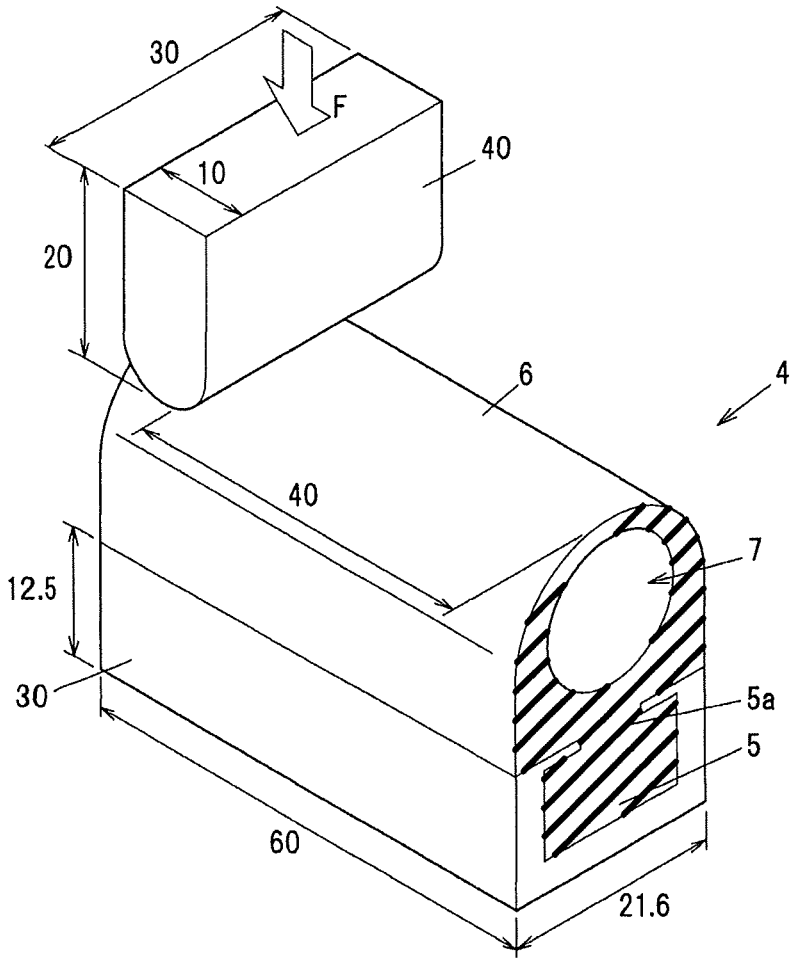
FIG. 10 is a perspective view showing a schematic configuration of a simulation apparatus for examining the state of deformation by applying a load to the door leading edge rubber.

FIG. 10 is a perspective view showing a schematic configuration of a simulation apparatus for examining the state of deformation by applying a load to the door leading edge rubber 4. As shown in FIG. 10, in this simulation apparatus, the door leading edge rubber 4 is attached to a base 30 and the load F is applied from the upper side by the pressing member 40 to the abutment part 6 of the door leading edge rubber 4.

The abutment part 6 of the door leading edge rubber 4 has a circular cavity 7, and the upper portion thereof has a semicircular shape, in which the cord switch 10 is disposed. In addition, the pressing member 40 has a substantially rectangular parallelepiped shape, and a lower portion contacting the abutment part 6 of the door leading edge rubber 4 has a semicircular shape. The numbers written near each arrow in the figure mean the respective dimensions, and the units are all mm.

The base 30 has a length (a longitudinal direction of the door leading edge rubber 4) of 60 mm, a width (a width direction of the door leading edge rubber 4) of 21.6 mm, and a height of 12.5 mm. Further, the pressing member 40 has a depth of 30 mm and a height of 20 mm. The width of the pressing member 40 was varied to 10 mm (the radius of the semi-circular lower portion of the pressing member 40 means 5 mm), 20 mm (the radius of the semi-circular lower portion of the pressing member 40 is 10 mm), 30 mm (the radius of the semicircular lower part of the pressing member 40 is 15 mm), 40 mm (the radius of the semi-circular lower part of the pressing member 40 is 20 mm) and used.

Figure 11:
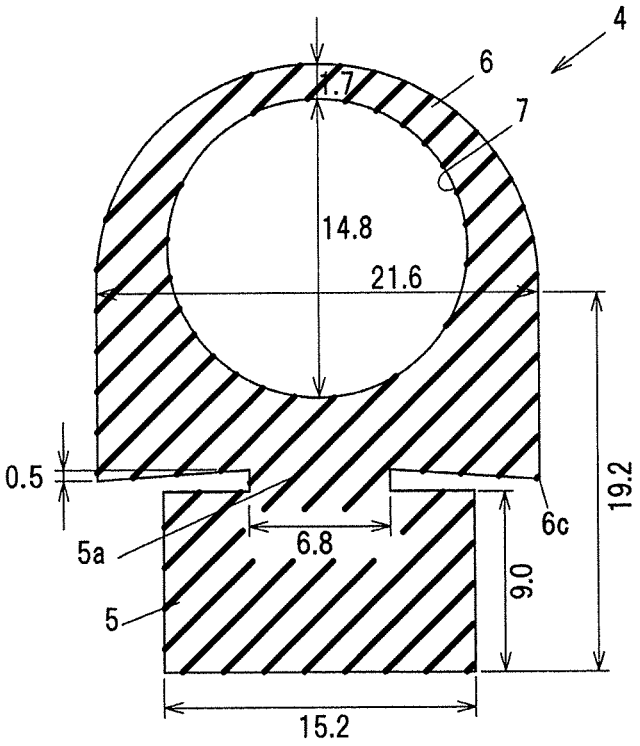
FIG. 11 is a cross sectional view showing detailed dimensions of each part of the door leading edge rubber to be simulated.

FIG. 11 is a cross sectional view showing detailed dimensions of each part of the door leading edge rubber 4 to be simulated. The numbers written near each arrow in the figure mean the respective dimensions, and the units are all mm. The width of the mounting part 5 is 15.2 mm, the height is 9.0 mm, the diameter of the cavity 7 is 14.8 mm, and the thickness of the upper portion of the abutment part 6 is 1.7 mm. An outer periphery of the abutment part 6 has a semicircular shape at the upper portion and a linear shape at the lower portion. The height from the lowermost portion of the mounting part 5 to the boundary between the semicircular portion and the linear portion of the abutment part 6 is 19.2 mm. The width of the connecting part 5*a* between the mounting part 5 and the abutment portion 6 is 6.8 mm, and an outer end portion 6*c* of the abutment part 6 is 0.5 mm lower than the connecting part 5*a*. Since the outer end portion 6 *c* of the abutment part 6 is lower than the connecting part 5*a*, the mounting part 5 becomes horizontal when fitted in the mounting groove 3*a* of the door 2 and is in close contact with the door 2.

Example 1

Figure 8A:
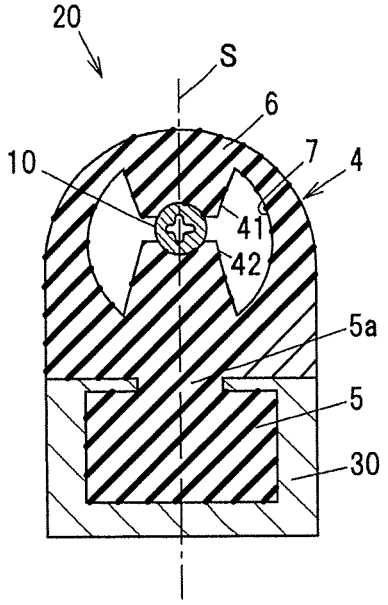
FIG. 8A is a sectional view showing a doorway sensor according to a third embodiment of the present invention, and is a sectional view showing an initial state in which no load is applied.

Example 1 has a configuration corresponding to the third embodiment, in which the cord switch 10 is disposed substantially in the center of the cavity 7 by the support member. In the simulation conducted in Example 1, plural of support members for supporting the cord switch 10 are provided in the cavity 7 of the abutment part 6, and the cord switch 10 is disposed substantially at the center of the cavity 7. In this simulation, as shown in FIG. 8A, a pair of protrusions 41, 42 are provided on the door leading edge rubber 4, and the cord switch 10 is disposed substantially in the center of the cavity 7 so as to sandwich the code switch 10 with these projections 41, 42.

Figure 8B:
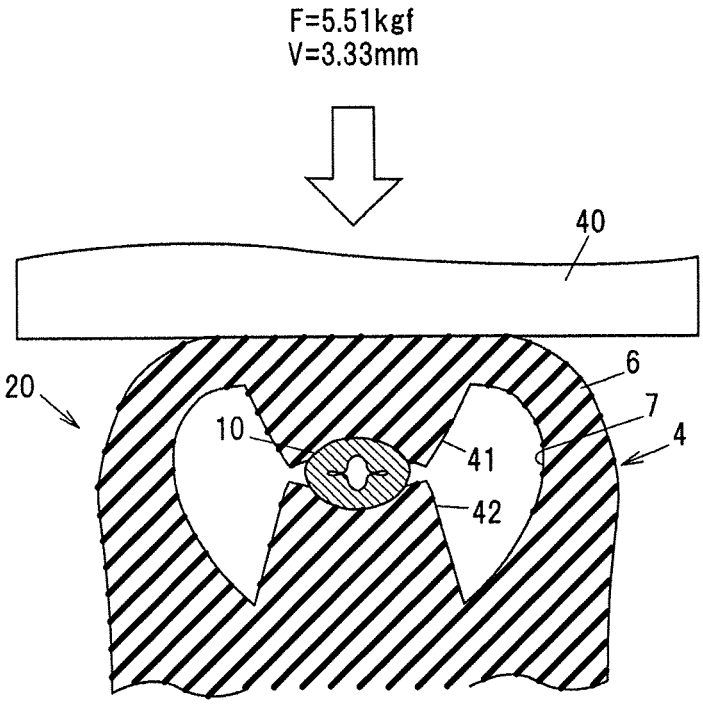
FIG. 8B is a cross sectional view showing a doorway sensor according to a third embodiment of the present invention, showing a state in which an abutment part is deformed by a load F.

In this simulation and the following simulation, the pressing member 40 pressed against the door leading edge rubber 4 while changing the load F. When the pressing member 40 pushes the upper end of the abutment part 6 of the door leading edge rubber 4 downward when the code switch 10 detects the occurrence of the door pinching state, the pushing amount with respect to the load F is obtained. The results are shown in Table 1. FIG. 8A is a cross sectional view showing the state of the simulation of Example 1 and showing an initial state in which no load is applied. FIG. 8B is a cross sectional view showing a state of a simulation of Example 1, and shows a state in which the abutment part is deformed by a load F (5.51 kgf).

TABLE 1

| The width of the pressing member 40 (mm) | Load (kgf) | Pushing amount (mm) |
|---|---|---|
| 10 mm | 5.51 | 3.33 |
| 20 mm | 5.82 | 3.02 |
| 30 mm | 6.12 | 2.92 |
| 40 mm | 6.73 | 2.97 |

According to Table 1, it can be seen that in Example 1, the code switch 10 detects the occurrence of the door pinching state with substantially the same pushing amount irrespective of the size of the pressing member 40. That is, it can be seen that Example 1 can detect the door pinching state without depending on the contact area between the door leading edge rubber and the foreign matter.

Example 2

Example 2 corresponds to the fourth embodiment, in which the cord switch 10 is disposed on the surface of the end portion of the projection 42 in the projecting direction. That is, in Example 2, the protrusion 41 is made smaller than the protrusion 42 on the mounting part 5 side, so that the cord switch 10 is disposed substantially at the center of the cavity 7 only by the protrusion 42.

Figure 9A:
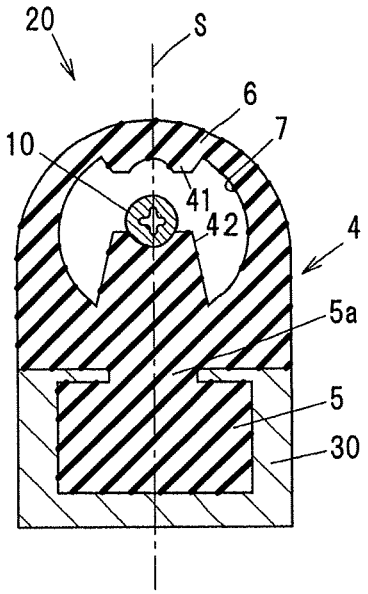
FIG. 9A is a sectional view showing a doorway sensor according to a fourth embodiment of the present invention, and is a sectional view showing an initial state in which no load is applied.
Figure 9B:
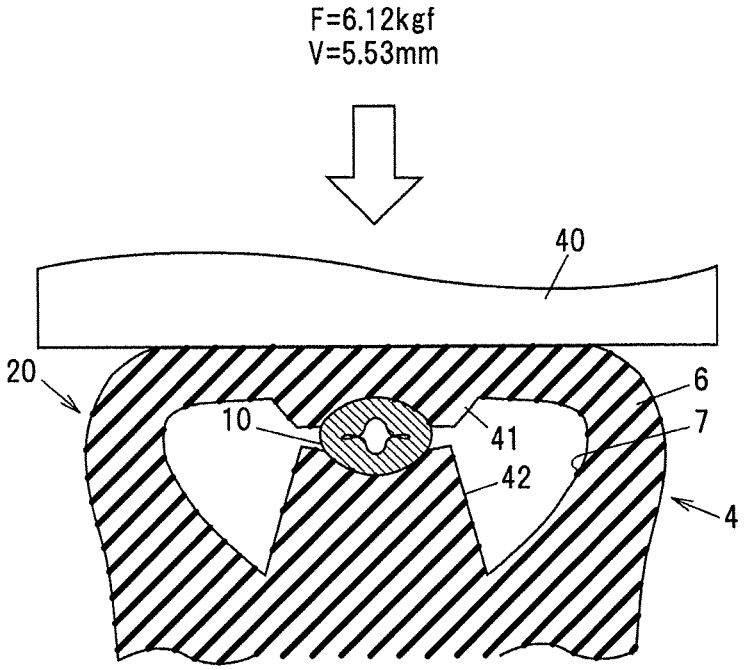
FIG. 9B is a cross sectional view showing a doorway sensor according to a fourth embodiment of the present invention, showing a state in which an abutment part is deformed by a load F.

FIG. 9A is a cross-sectional view showing the state of the simulation of Example 2 and showing the initial state in which no load is applied. FIG. 9B is a cross sectional view showing a state of the simulation of the second embodiment, showing a state in which the abutment part 6 is deformed by the load F (6.12 kgf). As shown in FIG. 9A, the cord switch 10 is disposed only in the protrusion 42 on the mounting part 5 side in the substantially central portion of the cavity 7. The protrusion 41 is made smaller than the protrusion 42 to open the upper side (closing direction side of the door 2) of the code switch 10. The results of this simulation are shown in Table 2.

TABLE 2

| The width of the pressing member 40 (mm) | Load (kgf) | Pushing amount (mm) |
|---|---|---|
| 10 mm | 5.51 | 5.32 |
| 20 mm | 6.12 | 5.11 |
| 30 mm | 6.12 | 4.95 |
| 40 mm | 6.73 | 4.95 |

According to Table 2, in Example 2, it can be seen that the code switch 10 detects the occurrence of the door pinching state with substantially the same pushing amount irrespective of the size of the pressing member 40. That is, in Example 2, it is possible to detect the door pinching state without depending on the contact area between the door leading edge rubber 4 and the foreign matter.

Example 3

Figure 12A:
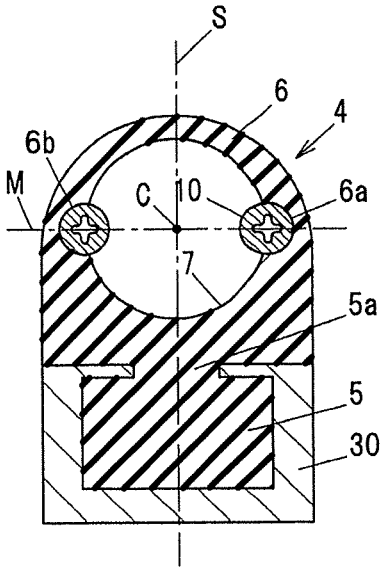
FIG. 12A is a cross sectional view showing the state of the simulation of Example 3 and showing the initial state in which no load is applied.
Figure 12B:
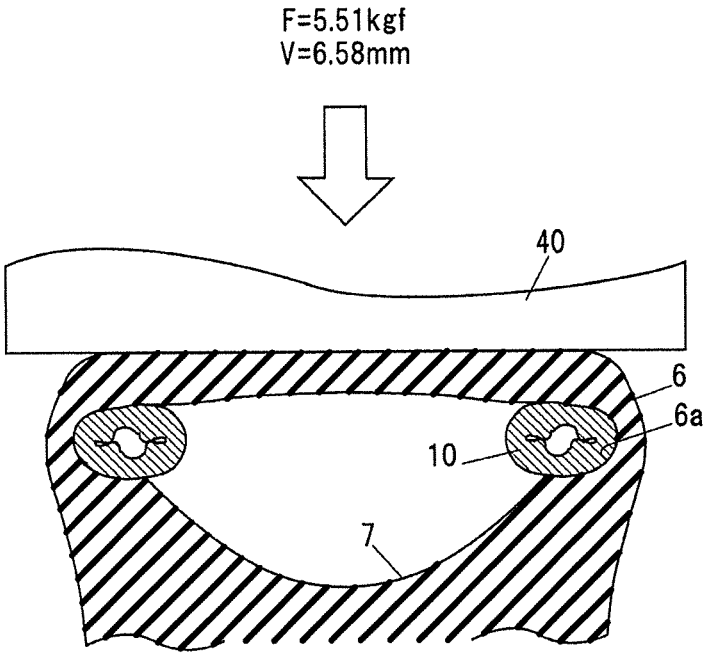
FIG. 12B is a cross sectional view showing the state of the simulation of Example 3, showing a state in which an abutment part is deformed by the load F.

In Example 3, the cord switch 10 is disposed on the side portion of the door leading edge rubber 4 corresponding to the first embodiment. Here, the code switch 10 is arranged within a range of ±40° with respect to a reference line M with reference to the center C of the cavity 7, wherein the reference line is perpendicular to the center plane S in the thickness direction W of the door and passes through the center C of the cavity 7. FIG. 12A is a cross sectional view showing the state of the simulation of Example 3 and showing the initial state in which no load is applied. FIG. 12B is a cross sectional view showing a state of the simulation of Example 3, showing a state in which the abutment part 6 is deformed by the load F.

In Example 3, the cord switch 10 may be disposed on the inner wall surface of the door leading edge rubber 4, but here, it is disposed at the center of the side portion of the inner wall surface of the door leading edge rubber 4. When the abutment part 6 is deformed by the load F, the side portion of the door leading edge rubber 4 is bent as shown in FIG. 12B, and the abutment part 6 applies pressure to the code switch 10 so as to sandwich the code switch 10. FIG. 12B is a cross sectional view showing a state in which the abutment part 6 is deformed by the load F (4.29 kgf). The results of the simulation are shown in Table 3.

TABLE 3

| The width of the pressing member 40 (mm) | Load (kgf) | Pushing amount (mm) |
|---|---|---|
| 10 mm | 5.51 | 6.58 |
| 20 mm | 5.82 | 6.23 |
| 30 mm | 6.73 | 6.24 |
| 40 mm | 7.35 | 6.20 |

According to Table 3, in Example 3, it is understood that the code switch 10 detects the occurrence of the door pinching state with substantially the same pushing amount regardless of the size of the pressing member 40. That is, in Example 3, it is possible to detect the door pinching state without depending on the contact area between the door leading edge rubber and the foreign matter.

Example 4

In Example 4, the cord switch 10 and the rigid member 18 are arranged on the door leading edge rubber 4 corresponding to the second embodiment. That is, in Example 4, a rigid member whose hardness is harder than that of the door leading edge rubber 4 was disposed on the inner wall surface closer to the mounting part 5 than the cord switch 10 provided on the side portion of the inner wall surface of the door leading edge rubber 4. Here, the mounting angle θ of the cord switch 10 is set to 15°, and the angle α is set to 30°, wherein the angle α is formed by the straight line connecting the center of the code switch 10 and the center C of the cavity 7 and the straight line connecting the center of the rigid member 18 and the center C of the cavity 7.

Figure 13A:
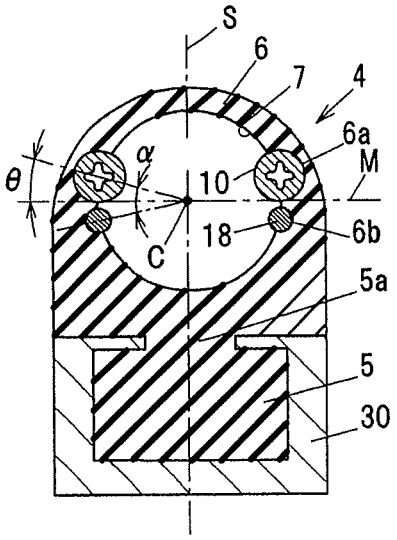
FIG. 13A is a cross sectional view showing the state of the simulation of Example 4 and showing the initial state in which no load is applied.
Figure 13B:
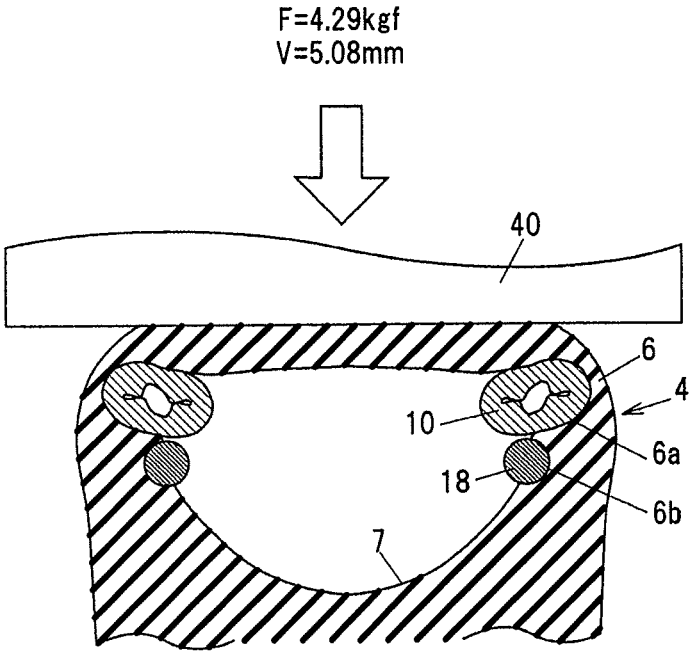
FIG. 13B is a cross sectional view showing the state of the simulation of Example 4, showing a state in which an abutment part is deformed by the load F.

FIG. 13A is a cross sectional view showing a state of a simulation of Example 4 and showing an initial state in which no load is applied. FIG. 13B is a cross sectional view showing a state of the simulation of Example 4, showing a state in which the abutment part 6 is deformed by the load F (4.29 kgf). In Example 4, the rigid member 18 harder than the door leading edge rubber 4 is provided closer to the mounting part 5 than the cord switch 10. The results of the simulation are shown in Table 4.

TABLE 4

| The width of the pressing member 40 (mm) | Load (kgf) | Pushing amount (mm) |
|---|---|---|
| 10 mm | 5.51 | 6.58 |
| 20 mm | 5.82 | 6.23 |
| 30 mm | 6.73 | 6.24 |
| 40 mm | 7.35 | 6.20 |

According to Table 4, in Example 4, it is found that the code switch 10 detects the occurrence of the door pinching state with substantially the same pushing amount irrespective of the size of the pressing member 40. That is, in Example 4, it is possible to detect the door pinching state without depending on the contact area between the door leading edge rubber 4 and foreign matter.

Simulation Result 2 on the Mounting Position of the Cord Switch

The relationship between the pushing amount and the load at the time of detection of the door pinch in each Example was examined in comparison with the deformation behavior of the door leading edge rubber 4 without the cord switch 10. Here, the analysis tool and various conditions are the same as the simulation described above, except that the simulation was performed with the width of the pressing member 40 fixed at 10 mm.

Reference Example

Reference Example does not have the code switch 10. For the purpose of comparison with Examples 1-4, a simulation was conducted on the door leading edge rubber 4 not having the cord switch 10.

Figure 14A:
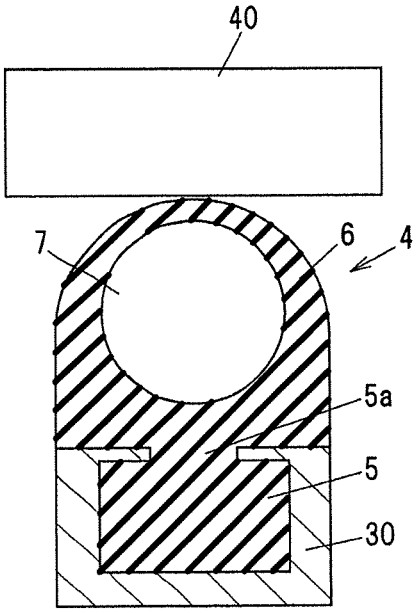
FIG. 14A is a cross sectional view showing the state of the simulation of Reference Example and showing the initial state in which no load is applied.
Figure 14B:
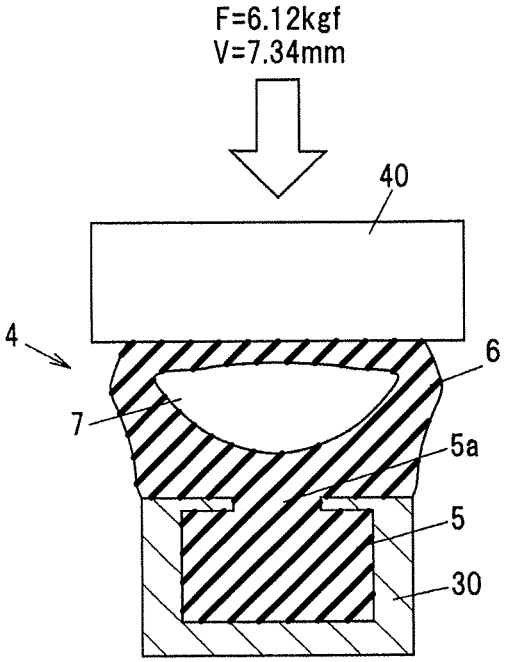
FIG. 14B is a cross sectional view showing the state of the simulation of Reference Example, showing a state in which an abutment part is deformed by the load F.

FIG. 14A is a cross sectional view showing a state of a simulation of a Reference Example and showing an initial state in which no load is applied. FIG. 14B is a cross sectional view showing a state of simulation of the Reference Example and showing a state in which the abutment part 6 is deformed by the load F (6.12 kgf).

In the initial state of FIG. 14A, a gap of 0.05 mm is provided between the lower portion of the pressing member 40 and the upper end of the abutment part 6 of the door leading edge rubber 4. In this simulation and the following simulation, the pressurizing member 40 was pressurized to the door leading edge rubber 4 from 0.31 kgf in load F to 6.12 kgf in approximately 0.3 kgf increments. Then, the pressing amount for each load F when the pressing member 40 pressed the upper end of the abutment part 6 of the door leading edge rubber 4 downward was obtained.

Figure 15:
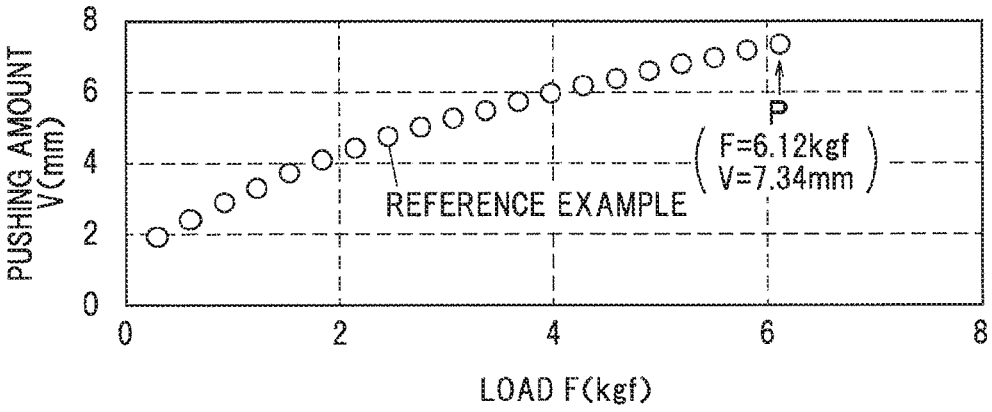
FIG. 15 is a graph showing the relationship between the load F and the pushing amount V in the simulation of Reference Example.

FIG. 15 is a graph showing the relationship between the load F and the pushing amount V in the simulation of the Reference Example. When the load F is 0.31 kgf, the pushing amount V is 1.93 mm. Thereafter, as the load F is gradually increased, the pushing amount V also gradually increases, and finally the pushing amount V when the load F shown in FIG. 15 becomes 6.12 kgf is 7.34 mm.

In Example 1, simulation was performed in the same manner as in the Reference Example. When the load F reached 5.51 kgf, the code switch 10 detected the occurrence of the door pinching condition. The pushing amount V at this time is 3.33 mm. Note that the detection of the occurrence of the door pinching state is performed by simulation, and the same is applied to other simulations.

Figure 16:
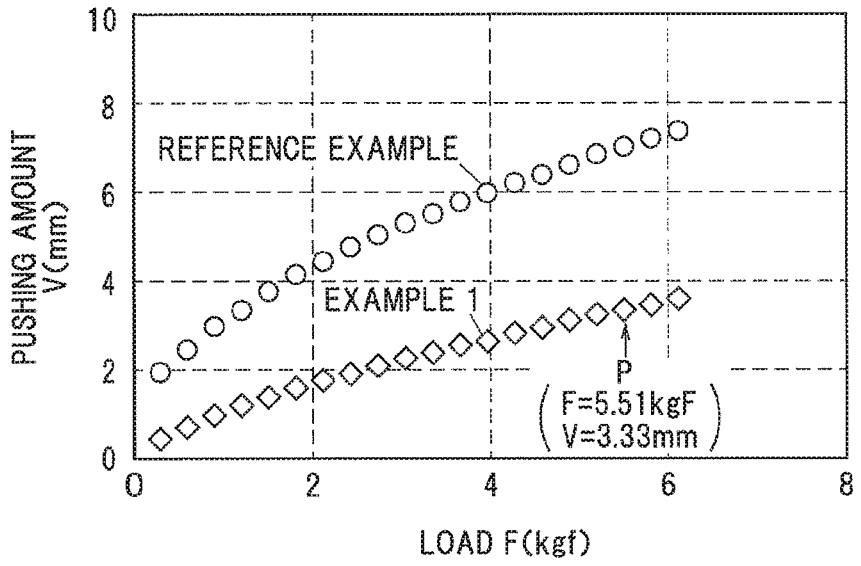
FIG. 16 is a graph showing the relationship between the load F and the pushing amount V in the simulation of Example 1.

FIG. 16 is a graph showing the relationship between the load F and the indentation amount V in the simulation of Example 1. In FIG. 16, white circles mean data of Reference Example, which are the same as the graph shown in FIG. 15. The results of the simulation of Example 1 are shown in white diamonds.

In this simulation, when the initial load F is 0.31 kgf, the pushing amount V is 0.41 mm. When the load F at the detection position P at which the code switch 10 detects the occurrence of the door pinching state is 5.51 kgf, the pushing amount V is 3.33 mm. Finally, when the load F reached 6.12 kgf, the pushing amount V was 3.56 mm.

In this way, when the cord switch 10 is sandwiched between the protrusions 41 and 42 and supported at substantially the center of the cavity 7, the pushing amount V is 3.33 mm (approximately 3.3 mm) with a load F of 5.51 kgf, and the pushing amount V with respect to the load F is small as compared with the Reference Example.

Simulation was performed on Example 2 by the same method as in the Reference Example. In Example 2, when the load F reached 6.12 kgf, the code switch 10 detected a door pinching state.

Figure 17:
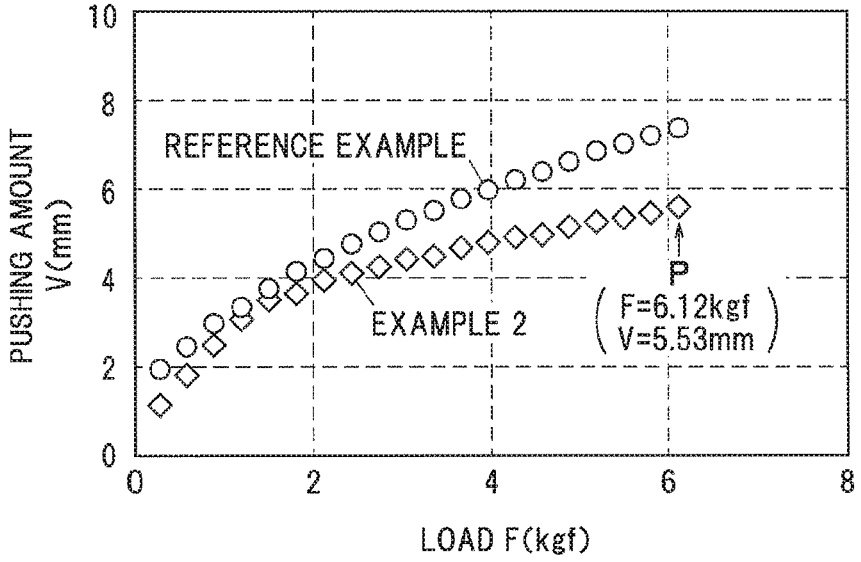
FIG. 17 is a graph showing the relationship between the load F and the pushing amount V in the simulation of Example 2.

FIG. 17 is a graph showing the relationship between the load F and the indentation amount V in the simulation of Example 2. In FIG. 17, similarly to FIG. 16, the graph of Reference Example is shown by white circles, and the simulation result of Example 2 is shown by white rhombuses. As shown in FIG. 17, when the initial load F is 0.31 kgf, the pushing amount V is 1.07 mm, and then the pushing amount V increases as the load F increases. However, after the load F exceeds approximately 2 kgf, the increase in the pushing amount V with respect to the increase in the load F is not so large. Finally, a the pushing amount V is 5.53 mm at a load F of 6.12 kgf at the detection position P where the code switch 10 detects the door pinching state.

As described above, in the simulation of Example 2, the pushing amount V is increased as compared with the simulation of the Example 1, but the load F at which the cord switch 10 detects the door pinching state is not more than 6 kgf, which is larger than that in Example 1. That is, it is understood that the detection of the door pinching state is faster in Example 1 than Example 2.

Simulation was performed on Example 3 in the same manner as in Reference Example. When the load F reached 5.51 kgf, the cord switch 10 detected a door pinching state.

Figure 18:
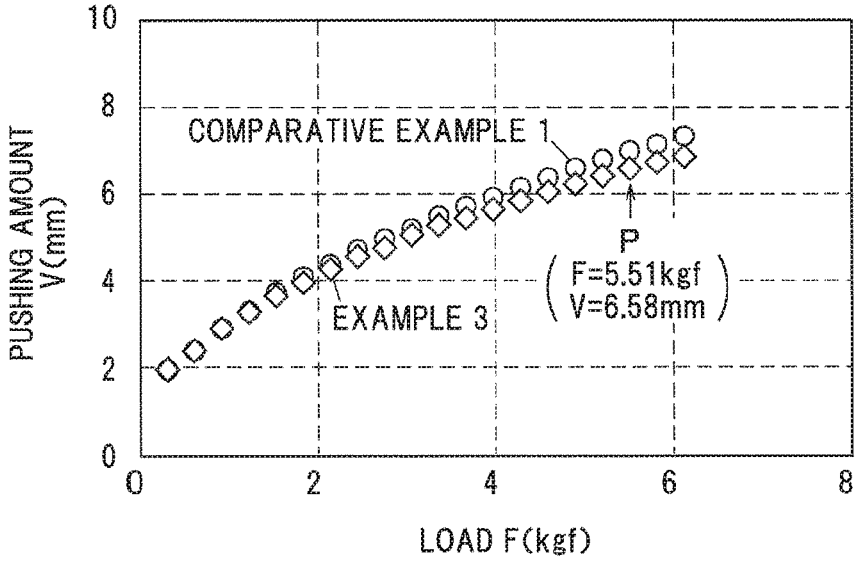
FIG. 18 is a graph showing the relationship between the load F and the pushing amount V in the simulation of Example 3.

FIG. 18 is a graph showing the relationship between the load F and the pushing amount V in the simulation of Example 3. In FIG. 18, similarly to FIG. 16, the graph of Reference Example is shown by white circles and the simulation result of Example 3 is shown by white rhombus. As shown in FIG. 18, the relationship between the load F and the pushing amount V in this simulation is very close to the graph of Reference Example in the case where the code switch 10 of FIG. 14 is not provided. Then, when the load F is 5.51 kgf, the detection position P at which the code switch 10 detects the door pinching state, and the pushing amount V at this time is 6.58 mm (about 6.6 mm).

As described above, in the case of Example 3, when the code switch 10 detects the door pinching state, a larger pushing amount V can be obtained with a smaller load F as compared with the simulation result of Example 2. This is the result that the code switch 10 disposed at the position is easy to detect the door pinching state, wherein the position that the cord switch 10 is sandwiched by the bending of the side portion of the abutment part 6 and the deformation of the recess 6*a* provided on the inner wall surface of the door leading edge rubber 4. According to Example 3, while showing the behavior of the pushing amount V and the load F substantially similar to those of Reference Example, there is the merit that the door pinching state can be detected at a faster timing.

Simulation was performed on Example 4 by the same method as in Reference Example. When the load F reached 4.29 kgf and the pushing amount reached 5.08 mm, the code switch 10 detected a door pinching state.

Figure 19:
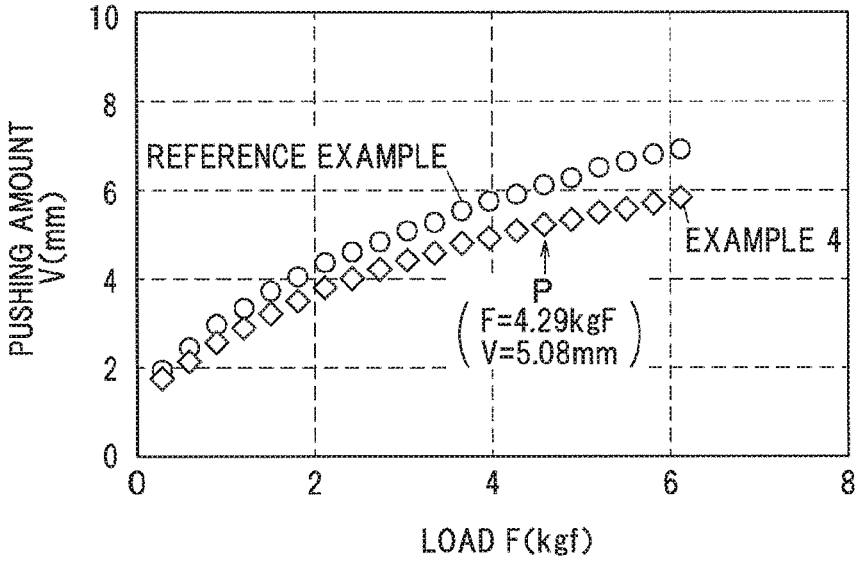
FIG. 19 is a graph showing the relationship between the load F and the pushing amount V in the simulation of Example 4.

FIG. 19 is a graph showing the relationship between the load F and the indentation amount V in the simulation of Example 4. In FIG. 19, similarly to FIG. 16, the graph of Reference Example is indicated by white circles, and the simulation result of Example 4 is shown by white diamonds. Compared to Example 3 in which only the cord switch 10 shown in FIG. 18 is provided on the side portion of the door leading edge rubber 4, in Example 4, the load F that detected the door pinching state is as small as 4.29 kgf. Therefor it is possible to detect the door pinching state more quickly. This is due to the result that the rigidity of the door leading edge rubber 4 of the door 2 in the opening direction Ba side is increased and the deformation timing of the code switch 10 is advanced by providing the rigid member 18 closer to the mounting part 5 side than the arrangement position of the cord switch 10. According to Example 4, while the behavior of the pushing amount V and the load F, which are substantially the same as those of Reference Example, are shown, there is an advantage that it is possible to detect the door pinching state at an earlier timing than in Example 3.

Mounting Angle of the Cord Switch

A simulation for exploring the optimum mounting angle by slightly shifting the attachment position of the code switch 10 was performed for Example 3.

Figure 20:
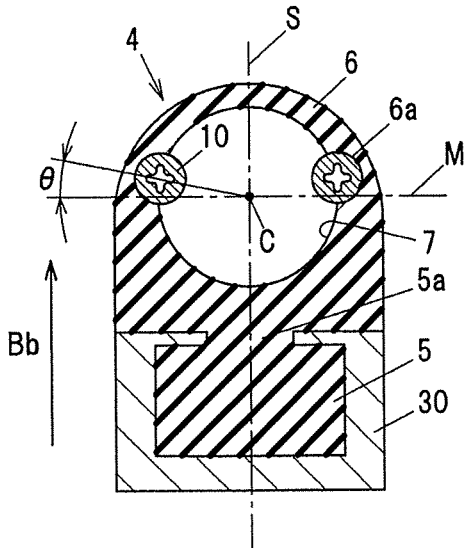
FIG. 20 is a cross sectional view for explaining the mounting angle of the cord switch according to Example 3.

FIG. 20 is a cross sectional view for explaining the mounting angle of the cord switch 10 of Example 3. As shown in FIG. 20, the cord switch 10 is disposed on the inner wall surface of the door leading edge rubber 4 so that the center of the code switch 10 is positioned closer to the closing direction side of the door 2 than the reference line M that is perpendicular to the center plane S in the thickness direction W of the door 2 and passes through the center C of the cavity 7. At this time, while varying the angle θ variously, simulation was performed to press the abutment part 6 from the above with the above-described pressing member 40, wherein the angle θ is formed by a straight line connecting the center of the code switch 10 and the center C of the cavity 7 with the reference line M perpendicular to the center plane S in the thickness direction W of the door 2 and passing through the center C of the cavity 7.

Figure 21A:
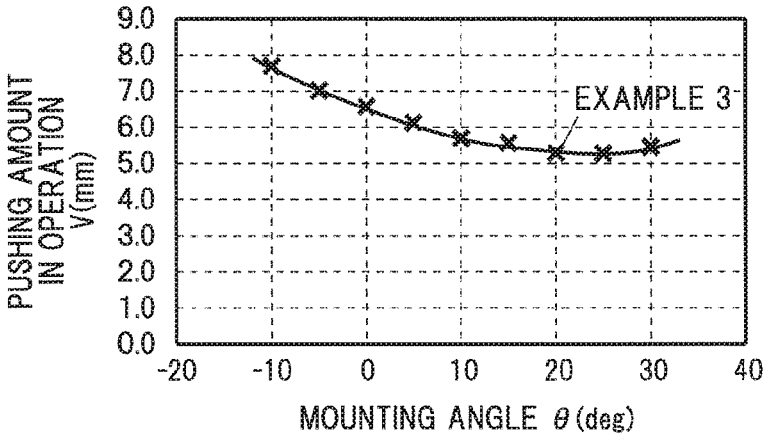
FIG. 21A is a graph showing the relationship between the mounting angle θ of the cord switch of Example 3 and the pushing amount V in operation.
Figure 21B:
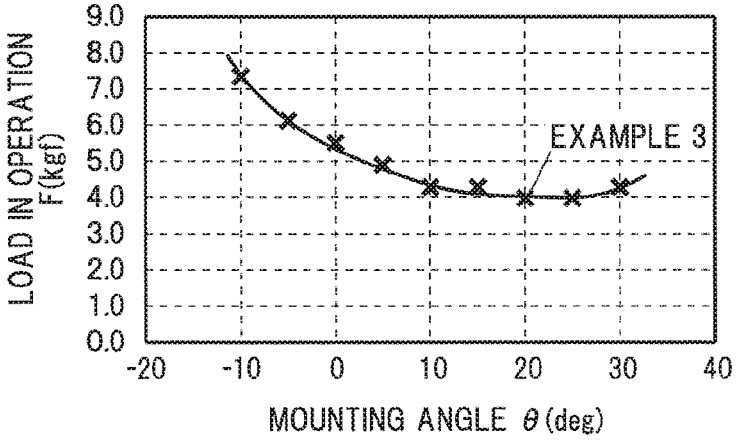
FIG. 21B is a graph showing the relationship between the mounting angle θ of the cord switch of Example 3 and the load F in operation.

FIG. 21A is a graph showing the relationship between the mounting angle θ of the cord switch 10 of Example 3 and the pushing amount V in operation. FIG. 21B is a graph showing the relationship between the mounting angle θ of the cord switch 10 of the Example 3 and the load F in operation. It should be noted that the term "during operation" refers to the time when the door closing state is detected when pressurizing the abutment part 6 with the pressing member 40.

As can be seen from FIG. 21, in the case of Example 3 including only the cord switch 10, when the mounting angle θ of the cord switch 10 is 20° to 25°, both the pushing amount V and the load Fg are minimized. That is, when the mounting angle θ is in this range, it is possible to detect the door pinching condition early with a small load F.

Figure 22:
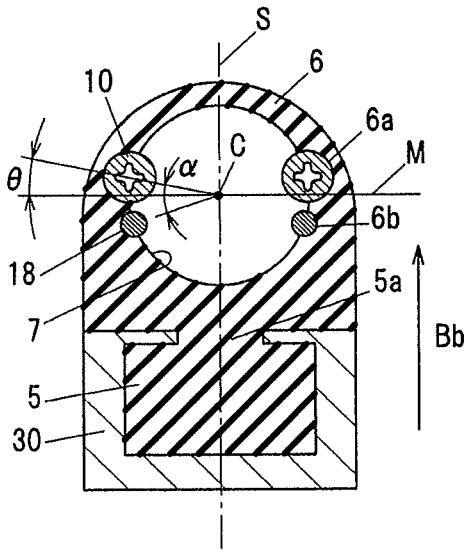
FIG. 22 is a cross sectional view for explaining the mounting angle of the cord switch according to Example 4.

FIG. 22 is a cross-sectional view for explaining the mounting angle of the cord switch 10 of Example 4. In Example 4, the angle α between the straight line connecting the center of the code switch 10 and the center C and the straight line connecting the center of the rigid member 18 and the center C is fixed at 30°.

Figure 23A:
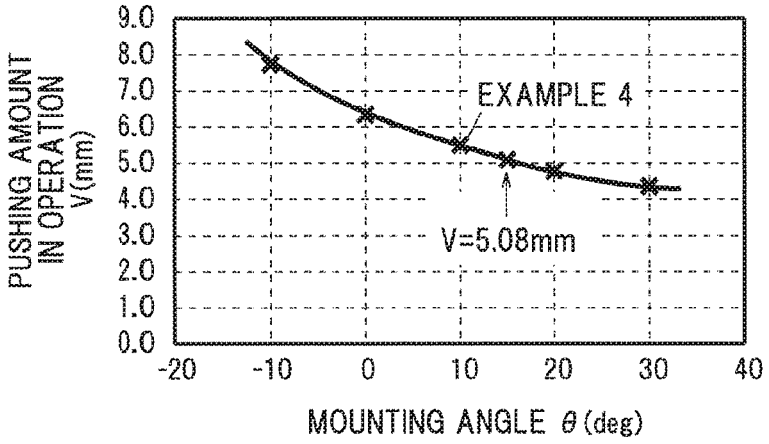
FIG. 23A is a graph showing the relationship between the mounting angle θ of the cord switch of Example 4 and the pushing amount V in operation.
Figure 23B:
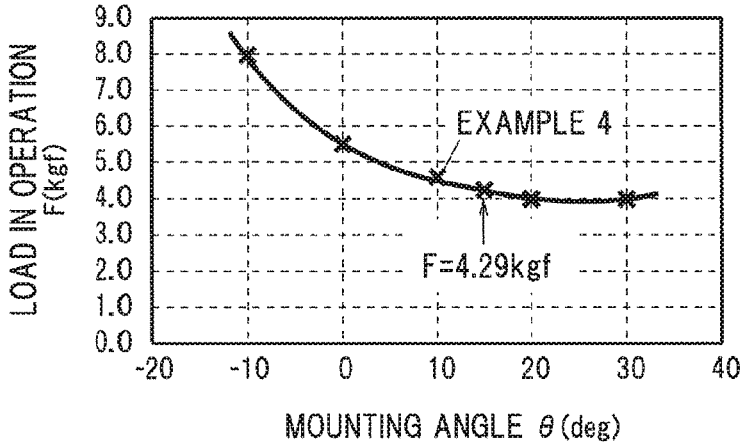
FIG. 23B is a graph showing the relationship between the mounting angle θ of the cord switch of Example 4 and the load F in operation

FIG. 23A is a graph showing the relationship between the mounting angle θ of the cord switch 10 of the fourth embodiment and the pushing amount V in operation. FIG. 23B is a graph showing the relationship between the mounting angle θ of the cord switch 10 of Example 4 and the load F in operation.

As described above, when the rigid member 18 is disposed closer to the mounting part 5 side than the arrangement position of the cord switch 10, both the pushing amount V and the load F in operation are similarly reduced to 10° as the mounting angle θ increases from −10°. However, when the mounting angle θ exceeds 20°, the decrease in the pushing amount V is suddenly reduced.

Regarding the mounting angle θ of the cord switch 10, in Example 3 in which the rigid member 18 is not provided, the angle is preferably 10° to 30°. In Example 4 in which the rigid member 18 is provided, the mounting angle θ is preferably 20° to 30°.

Modification

Although the embodiment of the present invention described above, the present invention is not limited to only these embodiments. The present invention can be modified in various ways without departing from the spirit of the present invention. For example, in each of the above-described embodiments, a case where a door leading edge sensor is applied to a train door described, but the door leading edge sensor of the present invention is applied to other doors such as a door provided at the home of a train, a sliding door of a vehicle such as an automobile, a door of an elevator, a door provided at the entrance of a building such as a building.

Further, in each of the above-described embodiments, the case where the door leading edge sensor is applied to a pair of doors where the front end portion of the door in the closing direction faces is described, but the door leading edge sensor may be applied to a single door that does not have opposed doors. For example, in the case of a train, it is also applicable to a vehicle with a single-door door.

Further, it is not necessary to provide the code switch over the entire length of the door leading edge sensor, but it may be formed only in a part of the entire length of the door leading edge sensor.

What is claimed is:

1. A door leading edge sensor, comprising:

a door leading edge elastic member which is attached to a leading edge portion of a door in a door closing direction, and which includes a vertically-extending cavity defined by a vertically-extending wall having portions that are transverse to the door closing direction; and at least one linear pressure sensitive member that is attached to the door leading edge elastic member and disposed within the cavity, wherein a tubular inner surface of the wall includes a vertically-extending recess therein, wherein part of the pressure sensitive member is disposed in the recess in the tubular inner surface, and another part of the pressure sensitive member is disposed in the cavity, wherein the pressure sensitive member comprises an insulator tube having an elasticity and a plurality of conductive members fixed to an inner surface of the insulator tube, the insulator tube is deformable in accordance with a deformation of the wall, wherein the plurality of conductive members are in a non-contact state when the insulator tube is not deformed and are in contact with each other when the insulator tube is deformed, wherein the vertically-extending cavity is intersected by a center plane of the door that is orthogonal to a thickness direction of the door, bisects a thickness of the door, and that is parallel to the door closing direction, and wherein the wall is configured to deform symmetrically with respect to the center plane and apply a force to the pressure sensitive member in a direction opposite to the door closing direction to deform the insulator tube when a force is applied to the door leading edge elastic member in the direction opposite to door closing direction.

2. The door leading edge sensor according to claim 1, wherein the wall has opposing side portions on opposite sides of the center plane, and the pressure sensitive member is attached to one of the opposing side portions.

3. The door leading edge sensor according to claim 2, wherein a rigid member harder than the door leading edge elastic member is attached to the door leading edge elastic member and the pressure sensitive member is attached to the door leading edge elastic member closer to a closing direction side of the door leading edge elastic member than the hard member.

4. The door leading edge sensor according to claim 2, wherein the at least one pressure sensitive member comprises a first pressure sensitive member and wherein the door leading edge sensor further comprises a second said pressure sensitive member, wherein the second pressure sensitive member is attached to another one of the opposing side portions opposite the one of the opposing side portions such that the first and second pressure sensitive members sandwich the center plane of the door.

5. The door leading edge sensor according to claim 4, wherein a rigid member harder than the door leading edge elastic member is attached to the door leading edge elastic member.

6. The door leading edge sensor according to claim 4, wherein the pressure sensitive members are attached to the opposing side portions in such a manner that a center of the insulator tube of each of the pressure sensitive members is located closer to a closing direction side of the door leading edge elastic member than a line that is perpendicular to the center plane of the door and passes through a center of the cavity.

7. The door leading edge sensor according to claim 6, wherein the center of the insulator tube of each of the pressure sensitive members is disposed on the wall such that an angle between a line connecting the center of the insulator tube and the center of the cavity and the line that is perpendicular to the center plane of the door is 20° to 30°.

8. The door leading edge sensor according to claim 6, wherein a rigid member harder than the door leading edge elastic member is attached to the door leading edge elastic member.

9. The door leading edge sensor according to claim 6, wherein the center of the insulator tube of each of the pressure sensitive members is disposed on the wall such that an angle between a line connecting the center of the insulator tube and the center of the cavity and the line that is perpendicular to the center plane of the door is 10° to 30°.

10. The door leading edge sensor according to claim 1, wherein a second said door leading edge elastic member is attached to a leading edge portion of a second door aligned with the door in the door closing direction, and wherein a second said pressure sensitive member is attached to the second door leading edge elastic member.

11. The door leading edge sensor according to claim 1, wherein a rigid member harder than the door leading edge elastic member is attached to the door leading edge elastic member and the pressure sensitive member is attached to the door leading edge elastic member closer to a closing direction side of the door leading edge elastic member than the hard member.

12. The door leading edge sensor according to claim 11, wherein the rigid member is formed of a metal and is rod-shaped.

13. The door leading edge sensor according to claim 11, wherein the rigid member is exposed to the cavity.

14. The door leading edge sensor according to claim 13, wherein the rigid member is formed of a metal and is rod-shaped.

15. The door leading edge sensor according to claim 11, wherein at least part of the rigid member is accommodated in a concave portion formed in the tubular inner surface of the wall.

16. The door leading edge sensor according to claim 15, wherein the rigid member is exposed to the cavity.

17. The door leading edge sensor according to claim 15, wherein the rigid member is formed of a metal and is rod-shaped.

* * * * *